United States Patent [19]

Kaufmann

[11] Patent Number: 4,953,709

[45] Date of Patent: Sep. 4, 1990

[54] MULTI-STAGE MEANS FOR SORTING MIXTURES OF SOLID MATERIALS

[75] Inventor: Hans Kaufmann, Flaesheim, Fed. Rep. of Germany

[73] Assignee: Kaufmann GmbH, Flaesheim, Fed. Rep. of Germany

[21] Appl. No.: 344,311

[22] Filed: Apr. 26, 1989

[30] Foreign Application Priority Data

Apr. 26, 1988 [DE] Fed. Rep. of Germany ..... 3813990

[51] Int. Cl.[5] ..... B03B 7/00; B03B 9/00

[52] U.S. Cl. ..... 209/44; 209/141; 209/469; 209/472; 209/496; 209/497; 209/504

[58] Field of Search ..... 209/19, 20, 31, 36, 209/44, 37, 132, 133, 138, 139.1, 140, 141, 422, 468, 469, 471, 472, 477, 484, 490, 494, 496, 497, 504, 508

[56] References Cited

U.S. PATENT DOCUMENTS

| | | | |
|---|---|---|---|
| R. 29,625 | 5/1978 | Summers | 209/469 |
| 2,586,818 | 2/1952 | Harms | 209/138 X |
| 3,102,092 | 8/1963 | Heath et al. | 209/140 |

FOREIGN PATENT DOCUMENTS

| | | | |
|---|---|---|---|
| 3517309 | 11/1986 | Fed. Rep. of Germany | 209/468 |
| 0856589 | 8/1981 | U.S.S.R. | 209/133 |

*Primary Examiner*—Johnny D. Cherry
*Assistant Examiner*—Edward M. Wacyra
*Attorney, Agent, or Firm*—Robert W. Becker & Associates

[57] ABSTRACT

An apparatus for sorting lightweight from heavy material in mixtures of solid materials containing lumpy, granular, and pulverous constituents substantially comprises an upright slim container having a lower portion into which material for sorting is introduced. Pulsating air flows are introduced from the exterior into the container, resulting in an upward flow of pulsating air which loosens the material for sorting and produces a fluidized bed. Simultaneously, the apparatus is vibrated up and down in a linear manner by vibrators to assist in loosening the material. The lightweight material floating in the air stream is conveyed to a discharge channel at the top end of the container, whereas heavy material rapidly sinks down to a tubular member into which a second pulsating air flow is introduced in order additionally to sort the heavy material in a last treatment stage inside the tubular member. Any fine material present passes through a screen into a collecting container from which it is blown out through a short pipe. A weight-dependent circuit periodically opens a closure device at the outlet of the tubular member so that heavy material that has accumulated therein can exit downwardly.

10 Claims, 3 Drawing Sheets

MULTI-STAGE MEANS FOR SORTING MIXTURES OF SOLID MATERIALS

BACKGROUND OF THE INVENTION

The present invention relates to a multi-stage sorting means or apparatus for sorting a mixture of solid materials into lightweight and heavy materials, the mixtures comprising lumpy, granular and pulverous constituents of differing specific gravity, such as mixtures of coal and mine waste, or ore and refined ore.

In a sorting device of this kind, differences in density between the solid components of a dry mixture are used for the purpose of separation. In the case of conventional box-like means for dry sorting, the entire sorting means is vibrated during operation and an adjustable pulsating air flow is introduced into the processing chamber in order to produce a fluidized bed. During the process, particles having lower specific gravity are raised by the pulsating air flow and enter an overflow as a result of vibration, whereas the denser particles collect at the bottom on a screen. For various reasons, separation attainable by these means is still unsatisfactory. For example, a clean separation cannot be obtained if the difference in density between the components that are to be separated is relatively slight. Frequently such sorting devices are difficult to operate unless they are continuously supplied with material for processing. Box-like sorting devices also take up a relatively large amount of space.

It is therefore an object of the present invention to provide a sorting means that can cleanly separate lighter from heavier material even when the differences in density between the particles to be separated are slight; furthermore, the sorting means should be very reliable, simple to operate, and economic in use. In addition, the sorting means should be compact.

BRIEF DESCRIPTION OF THE DRAWINGS

These and other objects and advantages of the present invention will appear more clearly from the following specification in conjunction with the accompanying schematic drawings, in which.

SUMMARY OF THE INVENTION

Figure 1:
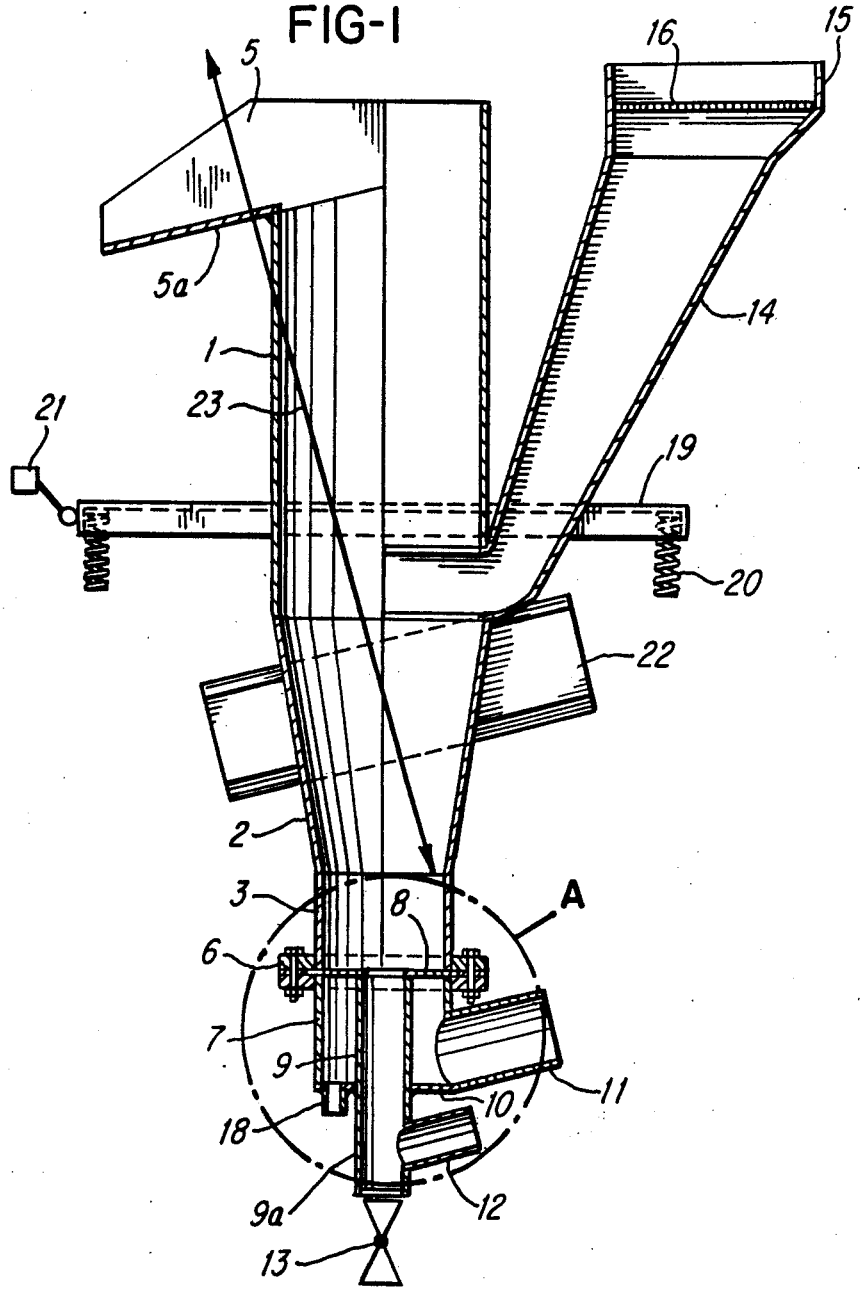
FIG. 1 is a cross-sectional view of one exemplary embodiment of the inventive sorting means from the side.
Figure 2:
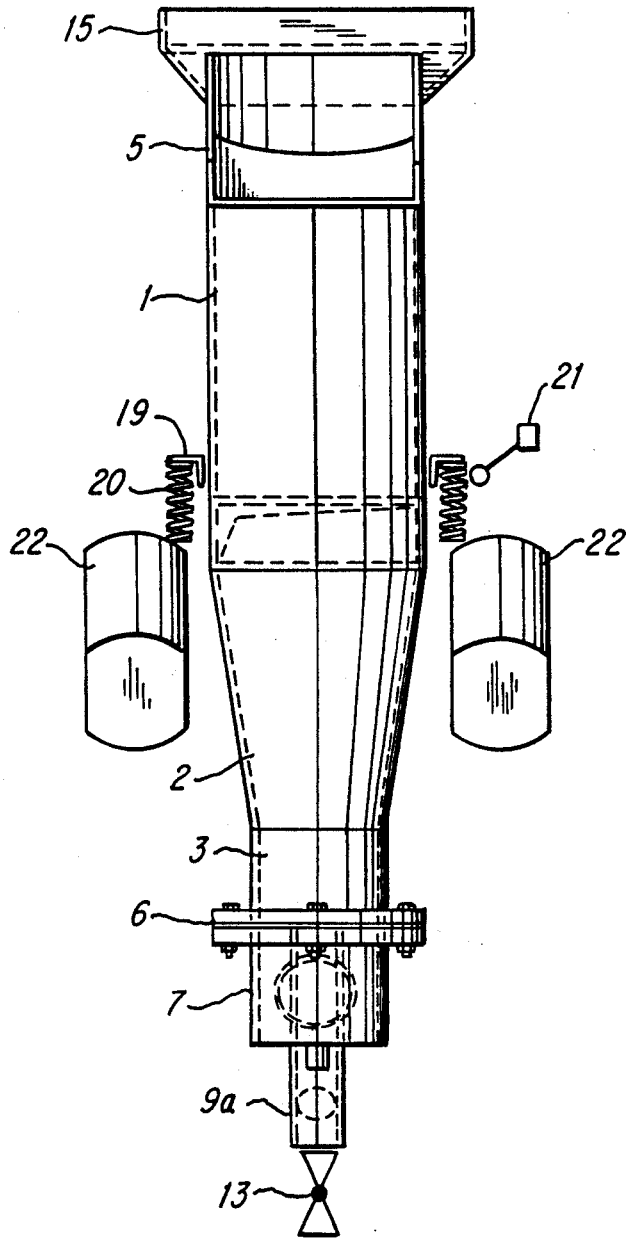
FIG. 2 is an end view of the sorting means of FIG. 1 in the direction towards the discharge channel.
Figure 3:
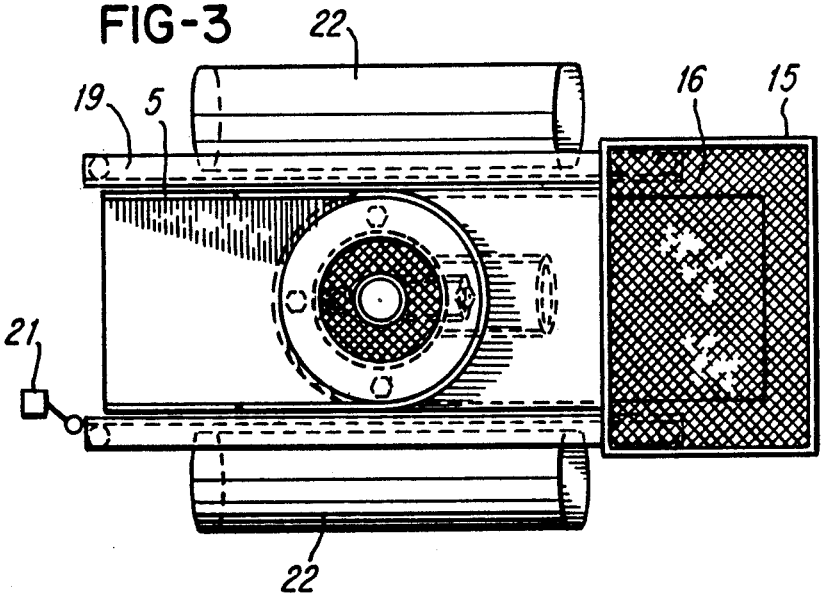
FIG. 3 is a plan view of the sorting means.

The sorting means of the present invention is characterized primarily in that: the material that is to be sorted is received in a slim upright container that comprises an upper cylindrical portion, a central downwardly tapering conical portion, and a lower cylindrical portion, the entire container being mounted for vibration on resilient support elements, such as springs or the like, and being vibratable by vibrators in a linear manner along an axis extending substantially transverse to the horizontal; an upwardly extending feed chute is connected to an opening in the container wall at the bottom end of the upper container portion and is provided with a feed hopper that is at the level of the top end of the upper portion; a delivery or discharge channel for lightweight material is connected to the top end of the upper container portion; a collecting container is secured by a flange connection to the lower container portion; a central tubular member extends through the collecting container, and the top end of the tubular member extends through an annular screen secured in the plane of separation of the flange connection; a controllable closure means is provided at the bottom end of the tubular member; respective upwardly extending air supply tubes are secured to the wall of the collecting container and to the wall of that part of the tubular member that extends beyond the collecting container; and a nozzle or short pipe for discharging fine material is attached to the base of the collecting container.

The main advantages of the present invention are that with the novel sorting means, the material that is to be processed is subjected to multiple treatment in superimposed stages on a relatively small base surface, resulting in an extremely effective and clean separation. In order to produce the fluidized bed, pulsating air flows are introduced through two tubes at the bottom end of the sorting means and are independently adjustable. The result inside the container is an upward flow of pulsating air which, assisted by the vibration of the container, loosens the mixture of solid materials and conveys lightweight material to the top of the container, where it leaves through a discharge channel. The upward air flow initially has a relatively high speed in the lower container portion, and slows down in the central portion as a result of the increased cross-section. In the upper portion the air flows at the reduced speed into the atmosphere, with substantially constant pulsation. The material being processed is therefore subjected to different air speeds in the three superimposed container portions.

The heavy material collects at the bottom and enters the central tubular member, through which also flows an upwardly directed stream of pulsating air at relatively high speed, whereby the tubular member constitutes a fourth processing stage for additional sorting. As soon as a preset amount of heavy material has collected in the tubular member, the previously closed interior is opened at the bottom end so that the heavy material can exit. The tubular member is then closed again and, after the preset amount of heavy material has again accumulated, is reopened, and so on. On each occasion the tubular member is automatically emptied as a function of the weight loading the container.

Other advantageous embodiments of the inventive sorting means are disclosed in the following paragraphs.

For example, the container is advantageously mounted for vibration via a frame on springs at at least three places. The vibrators are attached to the container, preferably at the side, substantially leVel With the horizontal center-of-gravity plane of the sorting means. Known vibrators for producing linear vibration can be used for this purpose.

Advantageously, the axis of vibration is slightly inclined, and is substantially disposed through the center of gravity of the sorting means. The inclination to the vertical can be about 22°. In order to assist in discharging the lightweight material, the axis of vibration is made to incline towards the discharge channel.

To prevent the material being sorted from caking after being fed, advantageously the feed chute has a larger cross-section at the beginning and tapers uniformly down to the inlet cross-section at its mouth.

Advantageously, a coarse screen is provided in the feed hopper to prevent undesirable clogging of the sorting means by excessively large solid materials.

The closure means at the bottom end of the tubular member can advantageously be automatically opened and closed as follows: an electrical switch connected to the base of the apparatus can be provided at a suitable place and can be actuated when the container sinks below its initial position after the load in it has reached a certain weight.

DESCRIPTION OF PREFERRED EMBODIMENTS

Referring now to the drawings in detail, in the illustrated embodiment, the container has a circular cross-section, but it may have any other desired cross-sectional shape. It may also be made of steel or some other metal.

The upright slim container comprises an upper cylindrical portion 1, a conical downwardly tapering central portion 2 that adjoins the bottom end of the top portion, and a lower cylindrical portion 3. The top end of the container portion is open, but alternatively could also be closed. A delivery or discharge channel 5 having an inclined base 5a is secured adjacent to a corresponding recess in the side wall near the top end.

Secured by a flange connection 6 at the bottom end of the lower cylindrical container portion 3 is a collecting container 7 that has approximately the same diameter as the bottom container portion 3. A ring or annular screen 8 having a central opening is secured between the clamped-together flanges of the connection 6. The central opening is occupied by the end of a tubular member 9 that extends through the center of the collecting container 7 and has an exposed portion 9a that projects beyond the base 10 thereof.

An upwardly extending air supply tube 11 is secured in the wall of the collecting container 7. A second, also upwardly extending air supply tube 12 is secured in the wall of the tube portion 9a. The tubes 12 extend upwardly so as to prevent material that is being processed from entering. A closure means 13, such as a changing valve, a pinch valve, or a slide valve, is disposed at the bottom end of the tubular member 9 and is used for opening or blocking the passage through the member 9.

An obliquely upwardly extending feed or delivery chute 14 having a cross-section that widens upwardly like a funnel, is secured to the bottom end of the container portion 1 for charging the apparatus, i.e. the sorting means, with material. In the illustrated embodiment, the feed chute 14 has a rectangular cross-sectional configuration. A feed hopper 15 is placed on the end of the chute 14, projects beyond the top of the container portion 1, and contains a coarse screen 16, e.g. a wire net, a perforated plate, etc.

Figure 4:
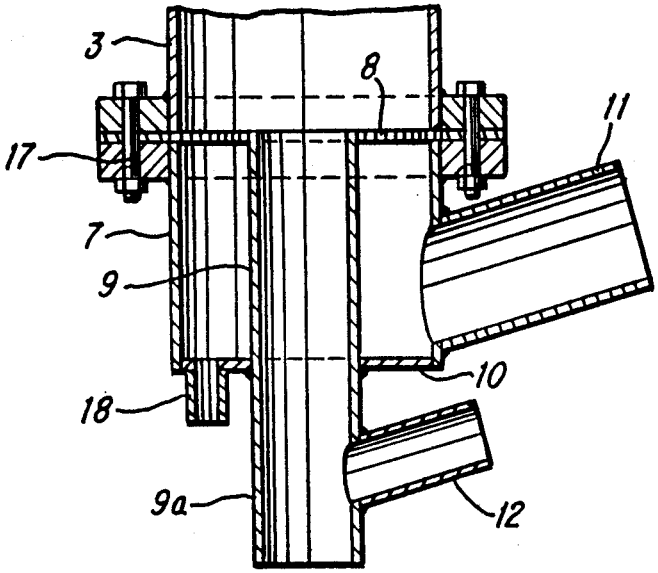
FIG. 4 shows dot-dash encircled portion A of FIG. 1 on a larger scale.

As the detailed view A in FIG. 4 shows, threaded bolts 17 are provided for clamping the flange connection 6. As the drawings also show, a short downwardly extending pipe 18 is secured to the base 10 of the collecting container 7.

The container is mounted for vibration on a sort of rectangular frame 19 that is made up of angle irons and surrounds the upper container portion 1. The sorting means is mounted on a foundation (not shown) via the frame 19 by springs 20 disposed at the corners of the frame. When the load of material for sorting that is supplied to the container reaches a preset weight, the springs 20 yield and the container sinks. This downward motion can be used to actuate an electric limit switch 21 that actuates the closure means 13 so as to open or block the tubular member 9.

In order to vibrate the sorting means in a linear manner at an angle to the vertical, vibrators 22 of known construction are disposed at the side of the container. The vibrators 22 are spatially oriented in such a way that the axis 23 of vibration slopes towards the discharge channel 5.

During operation of the inventive multi-stage sorting means, pulsating air flows are supplied through the tubes 11, 12 and can be adjusted in quantity, pressure, and frequency as required. Devices of this kind are known. The two air flows combine in the lower container portion 3 to form a common, upwardly directed, pulsating air flow that is operative as far as the top of the upper container portion 1. The intensive air flow upward through the container loosens the material that is being sorted and produces a fluidized bed. The loosening is facilitated by the high-frequency vibration. Lightweight material is carried by the pulsating air flow and is conveyed toward the discharge channel 5, whereas heavy material quickly sinks down to the tubular member 9, 9a. By means of a weight-dependent switching means and the limit switch 21, the closure means 13 is periodically opened so that the heavy material that has accumulated in the tubular member 9 can be discharged at the bottom.

The pulsating air flows upwardly through the superimposed container portions 1, 2 and 3 at different speeds and can therefore act with different intensities upon the material that is being processed. The heavy material in the tubular member 9, 9a additionally sorted by the air flow here, which is relatively fast. Any fine material that reaches the collecting container 7 through the screen 8 is blown out here through the short pipe 18.

If the pulsating air streams and the mechanical vibration are suitably matched to one another, a floating and sinking process occurs in the fluidized bed so as to cleanly separate lightweight material from heavy material even when the differences in specific gravity are slight.

The present invention is, of course, in no way restricted to the specific disclosure of the specification and drawings, but also encompasses any modifications within the scope of the appended claims.

What I claim is:

1. A multi-stage apparatus for sorting a mixture of solid materials into lightweight and heavy materials, with said mixture having lumpy, granular, and pulverous constituents of differing specific gravity, and being, for example, mixtures of coal and mine waste or ore and refined ore, said apparatus comprising:

a slim, upright container for receiving said material that is to be sorted, with said container comprising a cylindrical upper portion, a central downwardly tapering conical portion, and a cylindrical lower portion, with said entire container being mounted for vibration on resilient support element means;

vibrator means for vibrating said container in a linear manner along an axis that extends essentially transverse to the horizontal;

an upwardly extending feed chute, with said upper container portion having a top end, and a bottom end that is provided with an opening to which said feed chute is connected, said feed chute being provided with a feed hopper that is disposed at the level of said top end of said upper container portion;

a discharge channel for lightweight material disposed on said top end of said upper container portion;

a collecting container secured to said lower container portion via a flange connection that has a plane of separation, with said collecting container having a base remote from said flange connection;

a tubular member that extends centrally through said collecting container, with said tubular member having a top end, and remote therefrom a part that extends downwardly beyond said base of said collecting container and forms a bottom end of said tubular member;

an annular screen that is secured in said plane of separation of said flange connection and through which extends said top end of said tubular member to communicate with said lower container portion;

a controllable closure means provided at said bottom end of said tubular member;

a first upwardly extending air supply tube connected to and communicating with said collecting container;

a second upwardly extending air supply tube connected to and communicating with said downwardly extending part of said tubular member; and a short pipe attached to said base of said collecting container for the discharge of fine material therefrom.

2. An apparatus according to claim 1, in which said resilient support element means are springs.

3. An apparatus according to claim 2, in which said container, via frame means is mounted on said springs at at least three places.

4. An apparatus according to claim 1, which has a horizontal center-of-gravity plane, at approximately the level of which said vibrator means are disposed.

5. An apparatus according to claim 4, in which said vibrator means are mounted on sides of said container.

6. An apparatus according to claim 1, in which said axis of vibration extends approximately through a center of gravity of said apparatus and is inclined by about 22° relative to the vertical.

7. An apparatus according to claim 6, in which said axis of vibration is inclined in a direction toward said discharge channel.

8. An apparatus according to claim 1, in which said feed chute has an opening into said upper container portion and is uniformly tapered toward said opening.

9. An apparatus according to claim 1, in which a coarse screen is disposed in said feed hopper.

10. An apparatus according to claim 1, which includes a foundation therefor on which is provided electrical switch means that is activated, for effecting opening and closing of said closure means, in response to movement of said container to a certain position lower than its starting no-load position when said container contains a certain weight of material therein.

* * * * *